US006704522B2

(12) United States Patent
Sasago et al.

(10) Patent No.: US 6,704,522 B2
(45) Date of Patent: Mar. 9, 2004

(54) PROCESS CARTRIDGE COMPRISING STORING MEANS FOR STORING INFORMATION CONTROLLING A CHARGE ELIMINATION OPERATION AND ELECTROPHOTOGRAPHIC IMAGE FORMING APPARATUS COMPRISING CONTROLLING MEANS CONTROLLING A CHARGE ELIMINATION OPERATION

(75) Inventors: Yoshikazu Sasago, Shizuoka (JP); Yoshiyuki Batori, Shizuoka (JP); Takashi Akutsu, Kanagawa (JP); Masanari Morioka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/082,180

(22) Filed: Feb. 26, 2002

(65) Prior Publication Data

US 2002/0122672 A1 Sep. 5, 2002

(30) Foreign Application Priority Data

Feb. 28, 2001 (JP) ..... 2001-055862

(51) Int. Cl.[7] ..... G03G 15/00
(52) U.S. Cl. ..... 399/12; 399/128
(58) Field of Search ..... 399/12, 13, 111, 399/127–129

(56) References Cited

U.S. PATENT DOCUMENTS 5,512,988 A 4/1996 Donaldson
6,144,812 A 11/2000 Ueno ..... 399/12
6,188,852 B1 2/2001 Ojima et al. ..... 399/25
6,438,329 B1 * 8/2002 Budnik et al. ..... 399/12 X
6,498,905 B1 * 12/2002 Tsuruya ..... 399/12

* cited by examiner

*Primary Examiner*—William J. Royer
(74) *Attorney, Agent, or Firm*—Fitzpatrick, Cella, Harper & Scinto

(57) ABSTRACT

An electrophotographic image forming apparatus, capable of detachably mounting a process cartridge, for forming an image on a recording medium includes, a mounting portion for detachably mounting the process cartridge. The apparatus also includes a transporting member for transporting the recording medium, a controlling portion for controlling the operation of the electrophotographic image forming apparatus to execute the reading and/or the writing of the information to a storing member of the cartridge; and an exposing portion for exposing an electrophotographic photosensitive body of the cartridge to light. The electrophotographic image forming apparatus is configured to execute a charge elimination operation of the electrophotographic photosensitive body if the electrophotographic image forming apparatus determines that the process cartridge is in an unused state on the basis of the information from the storing member. As a result, an electrophotographic image forming apparatus and a process cartridge, both being capable of preventing the occurrence of image defects such as a black streak in an initial state of the process cartridge, are provided.

11 Claims, 12 Drawing Sheets

PROCESS CARTRIDGE COMPRISING STORING MEANS FOR STORING INFORMATION CONTROLLING A CHARGE ELIMINATION OPERATION AND ELECTROPHOTOGRAPHIC IMAGE FORMING APPARATUS COMPRISING CONTROLLING MEANS CONTROLLING A CHARGE ELIMINATION OPERATION

BACKGROUND OF THE INVENTION

1. Field of the Invention

The present invention relates to an electrophotographic image forming apparatus and a process cartridge capable of being mounted in the electrophotographic image forming apparatus.

2. Description of Related Art

Conventional image forming apparatuses using electrophotographic image forming processes employ a process cartridge system in which an electrophotographic photosensitive body and processing means working on the electrophotographic photosensitive body are integrally made to be a cartridge that is detachably attachable to the main body of the image forming apparatus. Because the process cartridge system makes it possible for a user to perform the maintenance of the image forming apparatus by himself or herself without asking a service person to maintain the apparatus, the system can remarkably improve the operability of the apparatus. Consequently, the process cartridge system is widely used in an image forming apparatus.

In such a process cartridge, a first frame body for rotatably supporting a developing roller being roller-like developing means and a second frame body for rotatably supporting a photosensitive body drum being a cylindrical electrophotographic photosensitive body are rotatably assembled with each other, and the photosensitive body drum and the developing roller are alongside disposed while keeping a small gap by a spacer, while also being biased to approach each other by a compressed coil spring or the like. Moreover, the first frame body includes a toner containing portion for containing toner being a developer, and the second frame body includes charging means and cleaning means. As the charging means, the so-called contact charging apparatus, which charges the surface of the photosensitive body drum uniformly by applying a voltage to a charging member contacting with the photosensitive body drum directly, has been proposed and practically used.

A representative contact charging apparatus is a roller charging apparatus. The roller (or a charging roller) generally includes a conductive base roller and a middle resistive layer formed on the surface of the base roller, and the roller follows the rotation of the photosensitive body drum and rotates in accordance with the rotation of the photosensitive body drum. A predetermined voltage is applied between the charging roller and the photosensitive body drum, and thereby the surface of the photosensitive body drum is charged at a uniform electric potential. Incidentally, the charging roller biased by a compressed coil spring or the like is in contact with the photosensitive body drum with a predetermined amount of nip.

On the other hand, the cleaning means generally touches a cleaning blade made of an elastic member of urethane or the like to the photosensitive body drum, and the cleaning blade scrapes residual toner on the photosensitive body drum to remove the residual toner from the photosensitive body drum. The scraped toner is collected into a waste toner containing portion in the second frame body. Moreover, the process cartridge is usually hermetically contained in a packing bag made of a light shielding sheet lest the photosensitive body drum should be exposed to outside light for a long time. In such a state, the process cartridge is usually housed in a packing case to be shipped. That is, in a process cartridge not used yet, the charging roller, the cleaning blade, and the like abut the surface of the photosensitive body drum at nearly the same position from the time when the process cartridge has been shipped to the time when the process cartridge is used.

However, in the case where the process cartridge is transported in the state mentioned above, stresses such as frictional force and the like caused by vibrations, impact and the like are applied to the portion of the photosensitive body drum where the charging roller and the cleaning blade abut, so that the photosensitive body drum is sometimes charged.

In many cases, the process cartridge is left as it is for a certain period, and the charge is naturally discharged. However, if the process cartridge is left as it is for a long time in the state such that the charging roller and the like abuts against the charged portion, the charge is not naturally discharged and is instead memorized on the photosensitive body drum sometimes. Consequently, a black streak or a white streak is produced on a formed image owing to the memorized charge.

SUMMARY OF THE INVENTION

The present invention was made for solving the aforesaid problem. An object of the invention is to provide an electrophotographic image forming apparatus and a process cartridge, both being able to prevent the occurrence of an image defect such as a black streak at the initial state of the process cartridge owing to the charging of the surface of an electrophotographic photosensitive body caused by frictional forces and the like arising from vibrations and impact during the transportation of the process cartridge.

Another object of the invention is to provide an electrophotographic image forming apparatus and a process cartridge, both being able to prevent the occurrence of image defects at the initial state of the process cartridge by judging whether the process cartridge is new or not and then by controlling the charge elimination operation of the surface of an electrophotographic photosensitive body on the basis of the judgment.

An image forming apparatus according to the present invention is an electrophotographic image forming apparatus, which is able to mount a process cartridge detachably, for forming an image on a recording medium, and the electrophotographic image forming apparatus includes mounting means for making the process cartridge detachably mountable, the process cartridge including an electrophotographic photosensitive body, processing means having at least either of charging means for charging the electrophotographic photosensitive body and cleaning means for cleaning the electrophotographic photosensitive body, and storing means for storing information; transporting means for transporting the recording medium; controlling means for controlling an operation of the electrophotographic image forming apparatus to execute reading and/or writing of the information to the storing means; and exposing means for exposing the electrophotographic photosensitive body to light, wherein the controlling means controls a charge elimination operation of the electrophotographic photosensitive body on a basis of the information in the storing means.

Moreover, a process cartridge according to the present invention is a process cartridge mountable in a main body of an electrophotographic image forming apparatus detachably, and the process cartridge includes an electrophotographic photosensitive body; charging means for charging a surface of the electrophotographic photosensitive body; cleaning means for cleaning the electrophotographic photosensitive body, and storing means for storing information, the storing means also storing a piece of information for controlling a charge elimination operation of the electrophotographic photosensitive body when the process cartridge is mounted in the main body of the electrophotographic image forming apparatus.

The present invention can prevent the occurrence of image defects such as a black streak at the initial state of a process cartridge owing to the charging of the surface of an electrophotographic photosensitive body caused by, for example, frictional forces and the like brought about by vibrations, and impact during the transportation of the process cartridge.

DESCRIPTION OF THE PREFERRED EMBODIMENTS

Hereinafter, an electrophotographic image forming apparatus and a process cartridge according to the present invention are described in detail on the basis of the attached drawings.

First Embodiment

At first, the entire configurations of the electrophotographic image forming apparatus and the process cartridge capable of being detachably mounted in the electrophotographic image forming apparatus are described.

Figure 4:
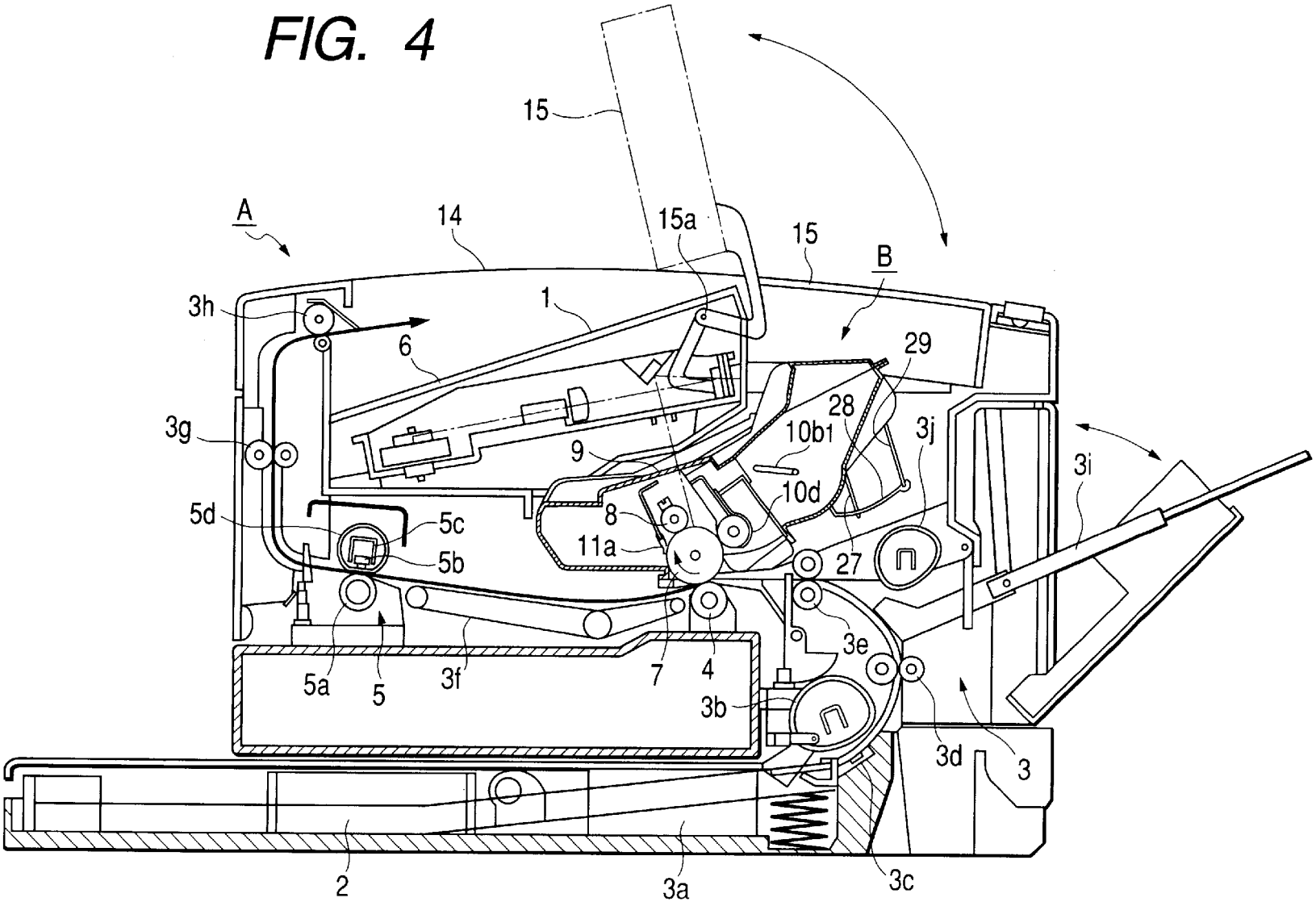
FIG. 4 is a schematic sectional view showing an embodiment of the electrophotographic image forming apparatus according to the invention.

The electrophotographic image forming apparatus A (a laser beam printer), as shown in FIG. 4, forms a latent image on a photosensitive drum 7, which is a cylindrically shaped electrophotographic photosensitive body and has been uniformly charged by a charging roller 8 being a roller-like charging member as charging means, by irradiating the photosensitive drum 7 with information light based on image information from an optical system 1. Next, the image forming apparatus A forms a toner image by developing the latent image. The image forming apparatus A separates and feeds a recording medium 2 one by one from a sheet feeding cassette 3*a* with a pickup roller 3*b* and a pressuring member 3*c* for pressuring the pickup roller 3*b* synchronously with the formation of the toner image. The apparatus A transports the separated recording medium 2 with transporting means including a pair of transportation rollers 3*d*, a pair of registration rollers 3*e*, and the like. Then, the apparatus A transfers the toner image formed on the photosensitive drum 7, which constitutes a cartridge as a process cartridge B, to the recording medium 2 by applying a voltage to a transferring roller 4 as transferring means. After that, the image forming apparatus A transports the recording medium 2 to fixing means 5 with a transporting belt 3*f*.

The fixing means 5 includes a drive roller 5*a* and a fixing rotation body 5*d*, which has a heater 5*b* therein and a cylindrical sheet supported by a supporting body 5*c* rotatably. The fixing means 5 fixes the toner image transferred on the passing recording medium 2 by applying heat and pressure to the recording medium 2. Then, the electrophotographic image forming apparatus A transports the recording medium 2, on which the recorded image is fixed, with pairs of delivery rollers 3*g* and 3*h* to deliver the recording medium 2 to a delivery portion 6 through a surface reverse transporting path.

Incidentally, the electrophotographic image forming apparatus A of the present embodiment is equipped with a manual paper feeding tray 3*i* and a roller 3*j* that make manual paper feeding possible.

Moreover, the electrophotographic image forming apparatus A is provided with a connecting portion (not shown) for exchanging information with a memory element 101 being storing means equipped in the process cartridge B. The connecting portion is wired with a controller 102 (see FIG. 1 and FIG. 2) as controlling means for executing various kinds of control of the apparatus A.

On the other hand, the process cartridge B includes an electrophotographic photosensitive body and at least either of charging means 8 for charging the electrophotographic photosensitive drum 7 and cleaning means 11 for cleaning toner remaining on the surface of the electrophotographic photosensitive drum 7. In the present embodiment, a process cartridge B equipped with the charging means 8, the cleaning means 11 and a developing means 10 for developing a latent image formed on the electrophotographic photosensitive drum 7 is exemplified as the process cartridge B.

Figure 5:
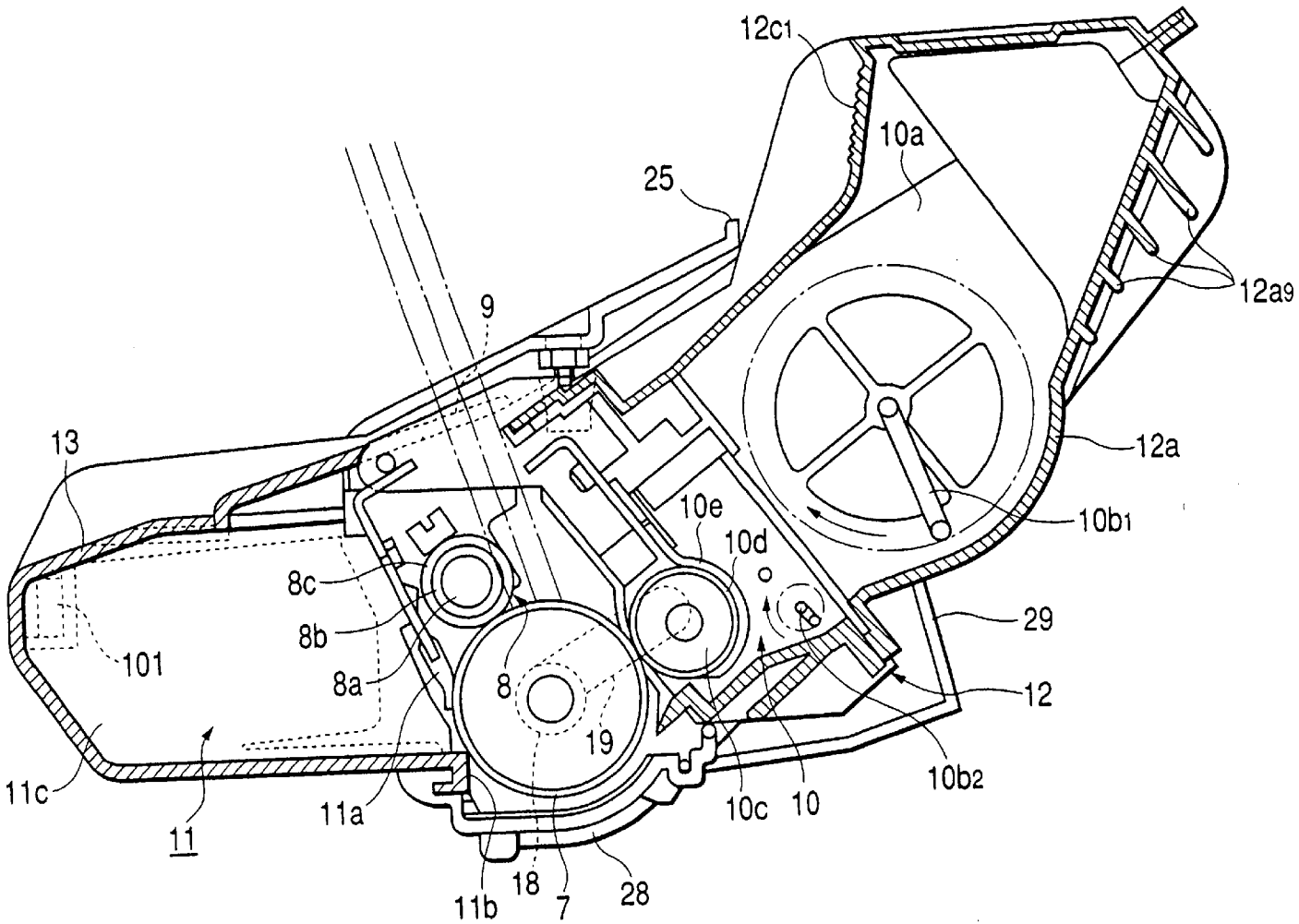
FIG. 5 is a schematic sectional view of an embodiment of the process cartridge according to the invention.

The process cartridge B of the present embodiment, as shown in FIG. 5 in more detail, rotates the photosensitive drum 7, which is a cylindrical electrophotographic photosensitive body having a photosensitive layer, and applies a voltage to the charging roller 8, which is a roller-like charging member as the charging means. Thereby, the process cartridge B uniformly charges the surface of the photosensitive drum 7. The process cartridge B forms a latent image on the photosensitive drum 7 by exposing the drum 7 to a light image from the optical system 1 through an opening portion 9. Then, the process cartridge B develops the latent image with developing means 10.

In the present embodiment, the charging roller 8 is composed of an electrically conductive elastic body 8*b* formed on a metal core 8*a* and a middle resistive layer 8*c* formed on the surface layer of the elastic body 8*b*. Both ends of the metal core 8*a* are supported rotatably. The charging roller 8 is pressed onto the outer peripheral surface of the photosensitive drum 7 at a predetermined pressing force. The charging roller 8 consequently follows the rotation of the photosensitive drum 7 and rotates in accordance with the rotation of the drum 7. A high voltage power supply (not shown) mounted in an apparatus main body 14 generally applies a superposed voltage (Vac+Vdc) of an alternating current (AC) component (Vac) having a peak-to-peak voltage (Vpp) being twice as large as a voltage at the time of a start of charging or more and a direct current (DC) component (Vdc) to the charging roller 8 through the metal core 8*a*. Thereby, the outer peripheral surface of the photosensitive drum 7, which is being driven to rotate, is processed to be uniformly charged by the AC application system.

The developing means 10 feeds toner in a toner containing portion 10*a* with a first toner feeding member 10*b*1 and a second toner feeding member 10*b*2, both being capable of rotating. Moreover, the developing means 10 rotates a developing roller 10*d* having a fixed magnet 10*c* therein, and forms a toner layer, to which triboelectification charges are given by a developing blade 10*e*, on the surface of the developing roller 10*d*. Then, the developing means 10 generally visualizes the toner borne by the developing roller 10*d* as a toner image by applying a developing bias composed of an AC voltage and a DC voltage superimposed on the AC voltage to the developing roller 10*d* to transfer the toner to the photosensitive drum 7 according to the latent image.

The electrophotographic image forming apparatus A transfers the toner image formed on the photosensitive drum 7 to the recording medium 2 by applying a voltage having a polarity reversed to that of the toner image to the transferring roller 4. After that, the cleaning means 11 scrapes the toner remaining on the photosensitive drum 7 with a cleaning blade 11*a* touching to the photosensitive drum 7, and scoops the scraped toner with a scooping sheet 11*b* to collect the scooped toner into a waste toner containing portion 11*c*. Thus the residual toner on the photosensitive drum 7 is eliminated to be fed to the formation of an image repeatedly.

Each member such as the photosensitive drum 7 is contained and supported in a cartridge frame body including a toner developing frame body 12 being a first frame body and a cleaning frame body 13 being a second frame body. The toner developing frame body 12 and the cleaning frame body 13 are coupled to be a cartridge, or the cartridge frame body, which is mounted in the apparatus main body 14. The toner developing frame body 12 rotatably supports the developing roller 10*d*, and the frame body 12 includes the toner containing portion 10*a* for containing the toner being a developer. The cleaning frame body 13 rotatably supports the photosensitive drum 7, and further the frame body 13 is provided with the charging roller 8 and the cleaning means 11. The frame bodies 12 and 13 are coupled with each other rotatably. And, the photosensitive drum 7 and the developing roller 10*d* are biased to approach to each other by means of a compressed coil spring and the like, and the photosensitive drum 7 and the developing roller 10*d* are disposed to be opposed to each other with a small gap packed by a spacer (not shown) between them.

Figure 1:
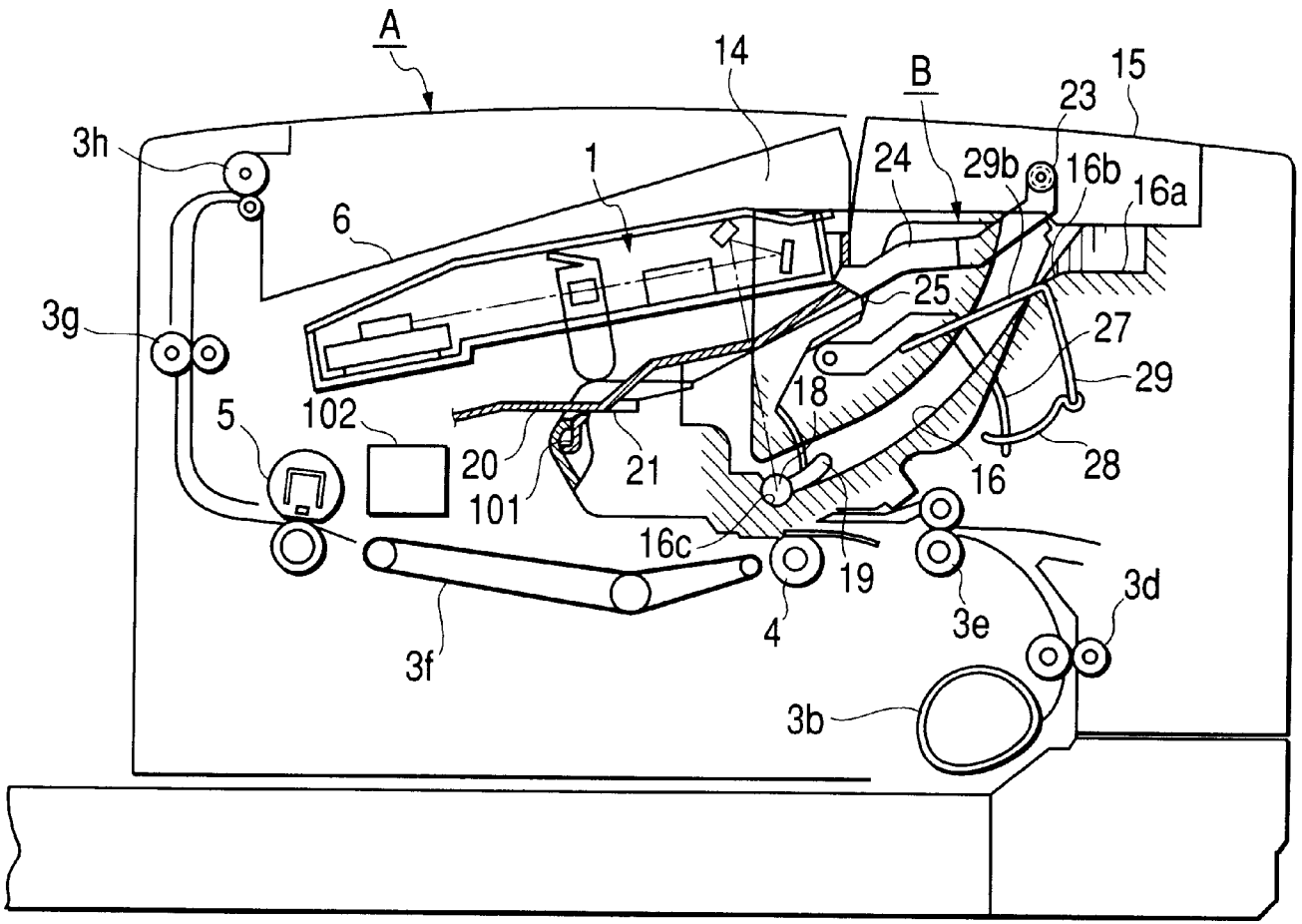
FIG. 1 is an explanatory view of the inside of an embodiment of an electrophotographic image forming apparatus according to the present invention.
Figure 2:
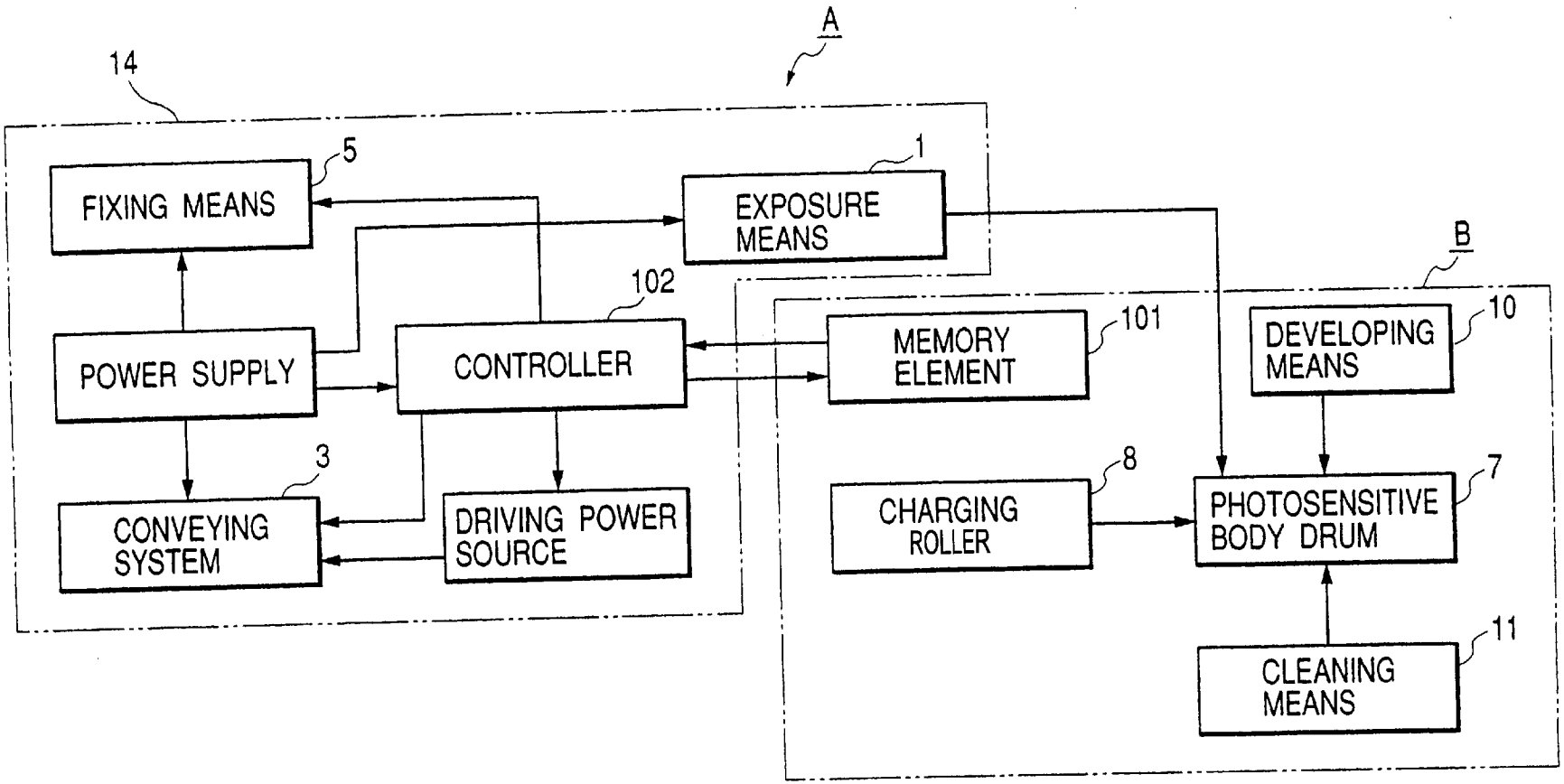
FIG. 2 is a block diagram showing the configurations of the apparatus main body and a process cartridge of an embodiment of the electrophotographic image forming apparatus according to the invention.

Moreover, the process cartridge B is provided with the memory element (or a memory) 101 being the storing means (see FIGS. 1 and 2). The memory element 101 is provided with a connecting portion (not shown) for making it possible to read or write information from the outside. Although the memory element 101 is not specially restricted, a normal electrical memory can preferably be used. The electrical memory can arbitrarily be configured to be a nonvolatile memory, a combination of a volatile memory and a backup cell, or the like.

Next, the configuration for the attachment and the detachment of the process cartridge B is described.

Figure 10:
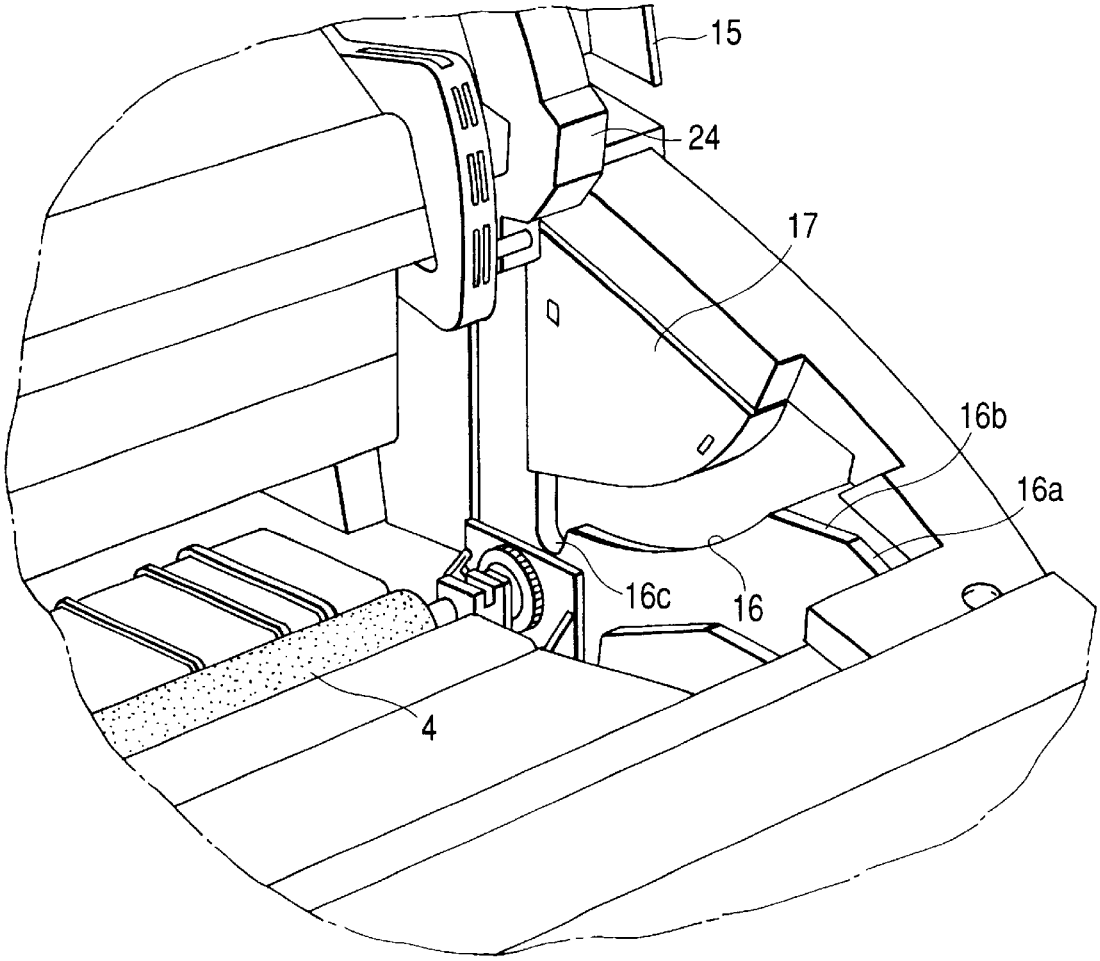
FIG. 10 is an explanatory perspective view of a right side guiding configuration for guiding the attachment and the detachment of the process cartridge from the apparatus main body.
Figure 11:
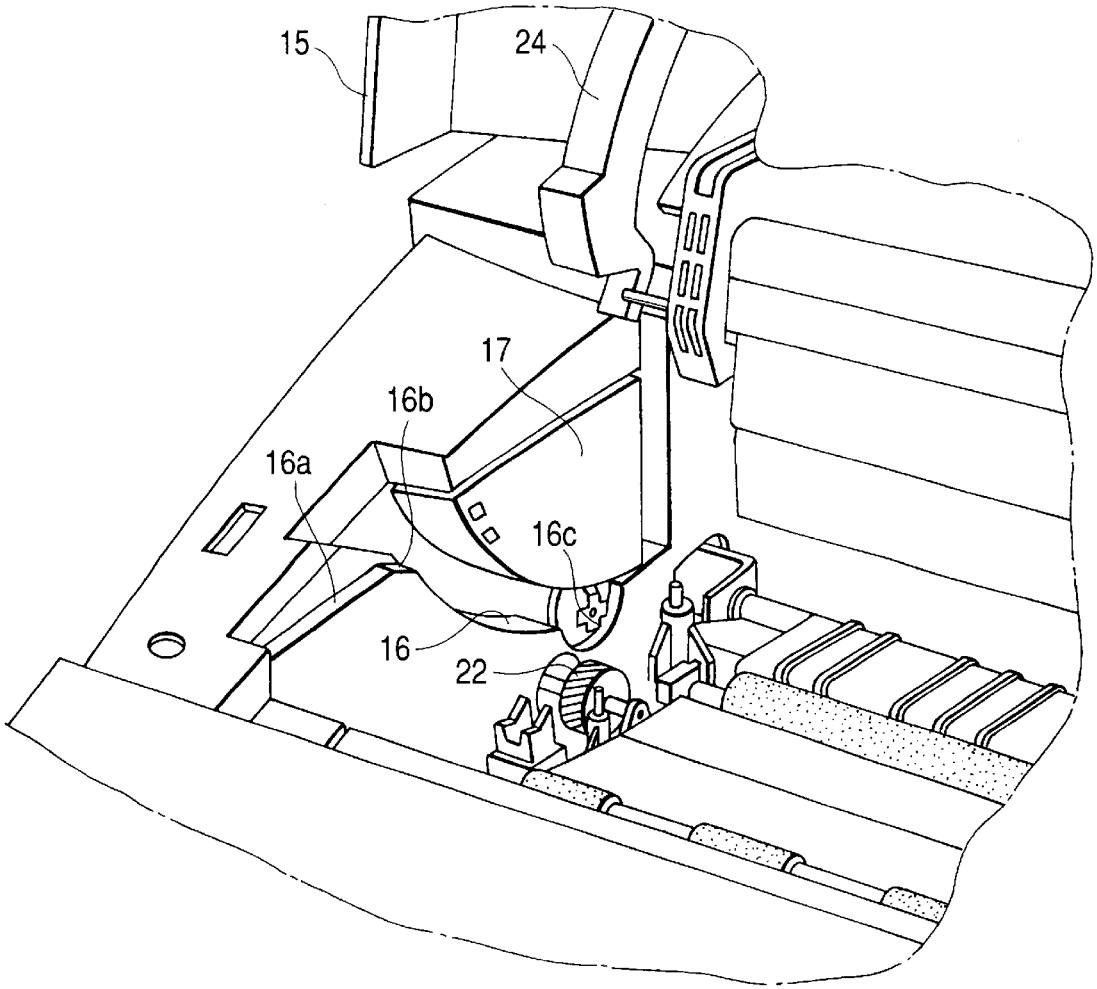
FIG. 11 is an explanatory perspective view of a left side guiding configuration for guiding the attachment and the detachment of the process cartridge from the apparatus main body.

Process cartridge mounting means includes guide rails 16 formed substantially symmetrically and in a curved shape (substantially an arc shape in the present embodiment). The front of guide rails 16 come down and swell downwards on both sides of the cartridge mounting space as shown in FIG. 10 and FIG. 11 in the state such that an opening and closing member 15 is opened around a shaft 15*a* (see FIG. 4). Moreover, above each of the guide rails 16 a guide member 17 is attached. Furthermore, at the entrance side of each of the guide rails 16, a first inclining plane 16*a* is formed, and a second inclining plane 16*b* having an inclination larger than that of the first inclining plane 16*a* is formed successively to the first inclining plane 16*a*.

Figure 6:
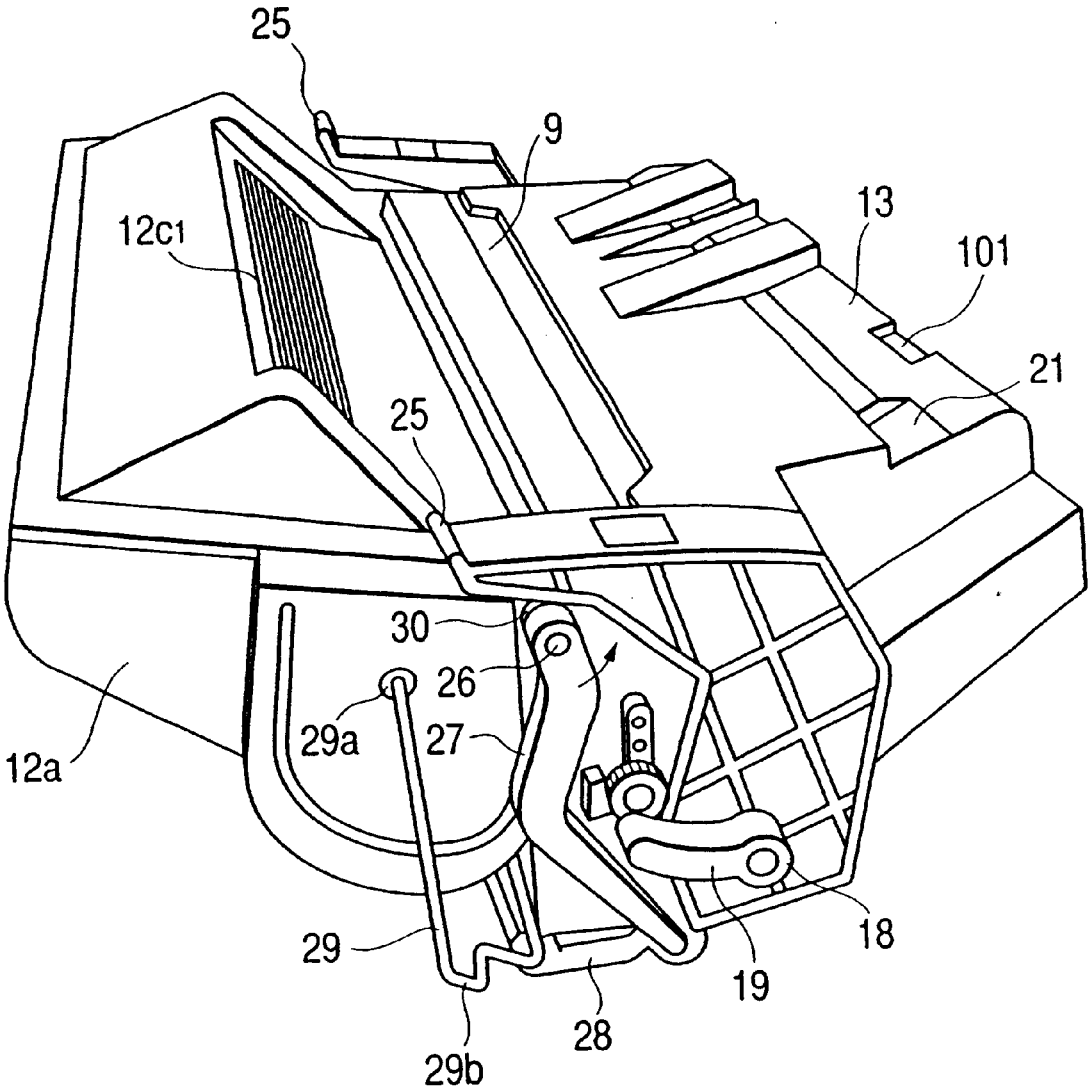
FIG. 6 is an explanatory perspective view showing the external appearance of an embodiment of the process cartridge according to the invention.

On the other hand, guide portions to be guided along the guide rails 16 are formed on both sides of the process cartridge B in the lengthwise direction thereof correspondingly to the guide rails 16. The guide portions are formed as if they project from positions being substantially symmetrical on the right side and the left side on both of the outside surfaces of the cartridge frame body in the lengthwise direction thereof. As shown in FIG. 6, each of the guide portions is composed of a boss 18 and a rib 19 that are integrated into one body. The boss 18 and the rib 19 are integrally formed on the cleaning frame body 13 to which the photosensitive drum 7 is attached. The bosses 18 are positioned on an extended line of the rotation shaft of the photosensitive drum 7. The ribs 19 are formed to be extended in the shapes of a curve (substantially arc shapes in the present embodiment) to swell downwards in accordance with the shapes of the guide rails 16 to the rear side in the insertion direction of the process cartridge B successively to the bosses 18.

Figure 7:
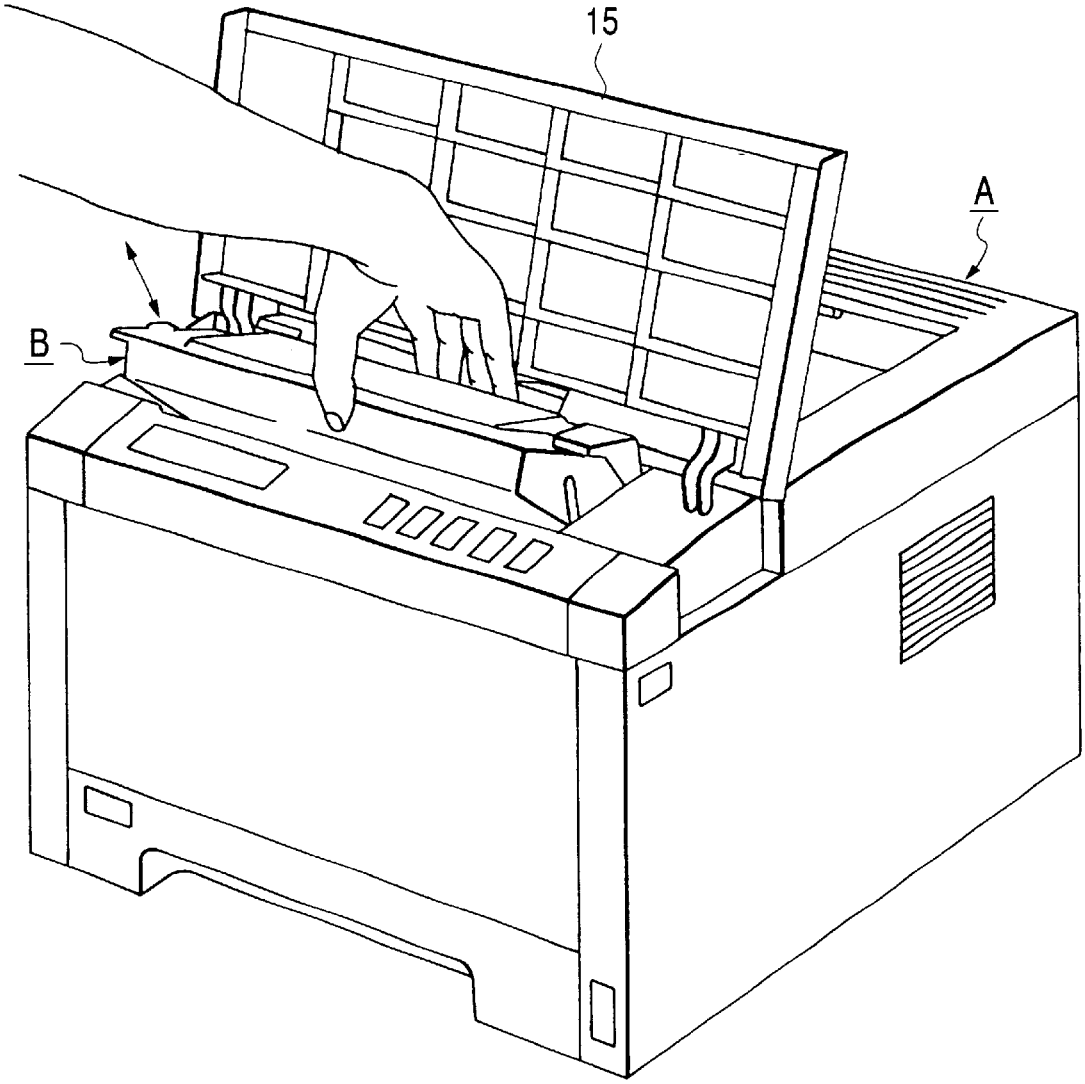
FIG. 7 is an explanatory perspective view of an operation of mounting the process cartridge in the apparatus main body.
Figure 9:
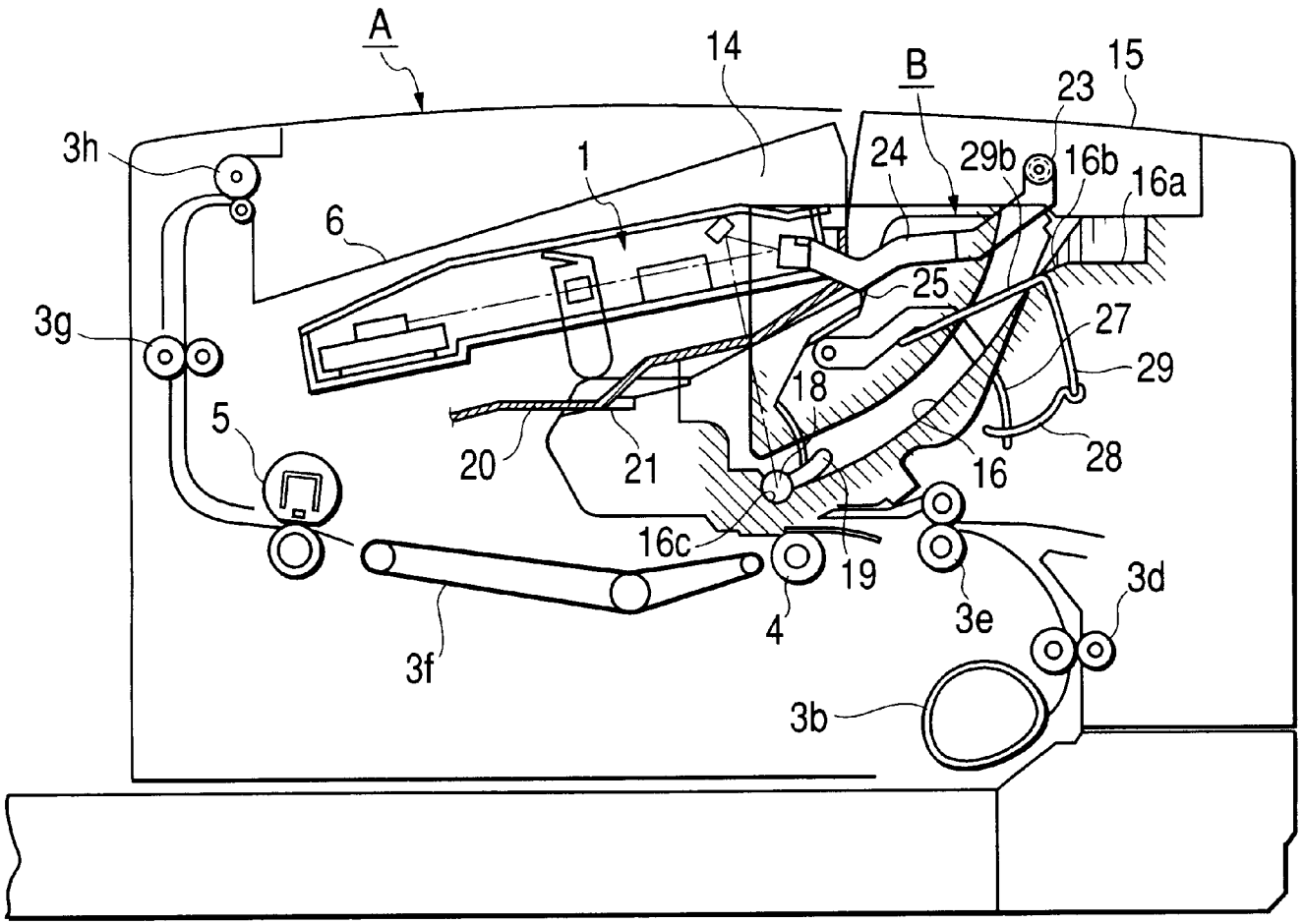
FIG. 9 is an explanatory inside view of the electrophotographic image forming apparatus with the process cartridge being completely mounted in the apparatus main body.

When the process cartridge B is mounted in such a configuration, as shown in FIG. 7 and FIG. 9, the opening and closing member 15 is opened; the bosses 18 and the ribs 19 advance along the guide rails 16 while the leading edge of the process cartridge B goes under the optical system 1 of the apparatus main body 14; and then the process cartridge B is inserted into the apparatus main body 14. The guide rails 16 are formed to be substantially an arc, and the guide members 17 located above the guide rails 16 have a shape similar to those of the guide rails 16. On the other hand, because the ribs 19 have the similar substantially arc shapes, the process cartridge B becomes substantially horizontal as it is inserted downwards.

When the process cartridge B is further pushed into the apparatus main body 14, a bumping member 20 formed on the apparatus main body 14 touches a touch surface 21 formed near to both the end portions of the leading edge of the cleaning frame body 13. Successively, the bosses 18 of the process cartridge B fall into reception concave portions 16*c* formed at the terminals of the guide rails 16. Thereby, drum gears (not shown) fixed at the side ends of the photosensitive drum 7 mesh with driving gears 22 (see FIG. 11) on the side of the apparatus main body 14 to make it possible to transmit a driving force to the process cartridge B.

Next, when the opening and closing member 15 is closed, as shown in FIG. 9, a pressure member 24 that is supported by the opening and closing member 15 around its shaft and is biased by a torsion coil spring 23 touches an arm portion 25 of the cleaning frame body 13 to pressurize the arm portion 25 at a predetermined pressure while twisting the torsion coil spring 23. Moreover, at this time, the bumping member 20 formed on the apparatus main body 14 and the touch surface 21 of the process cartridge B touch each other to position and mount the process cartridge B. Moreover, the connecting portion formed on the apparatus main body 14 and the connecting portion formed on the process cartridge B are connected to each other, and it becomes possible for the memory element 101 to communicate with the controller 102.

Figure 12:
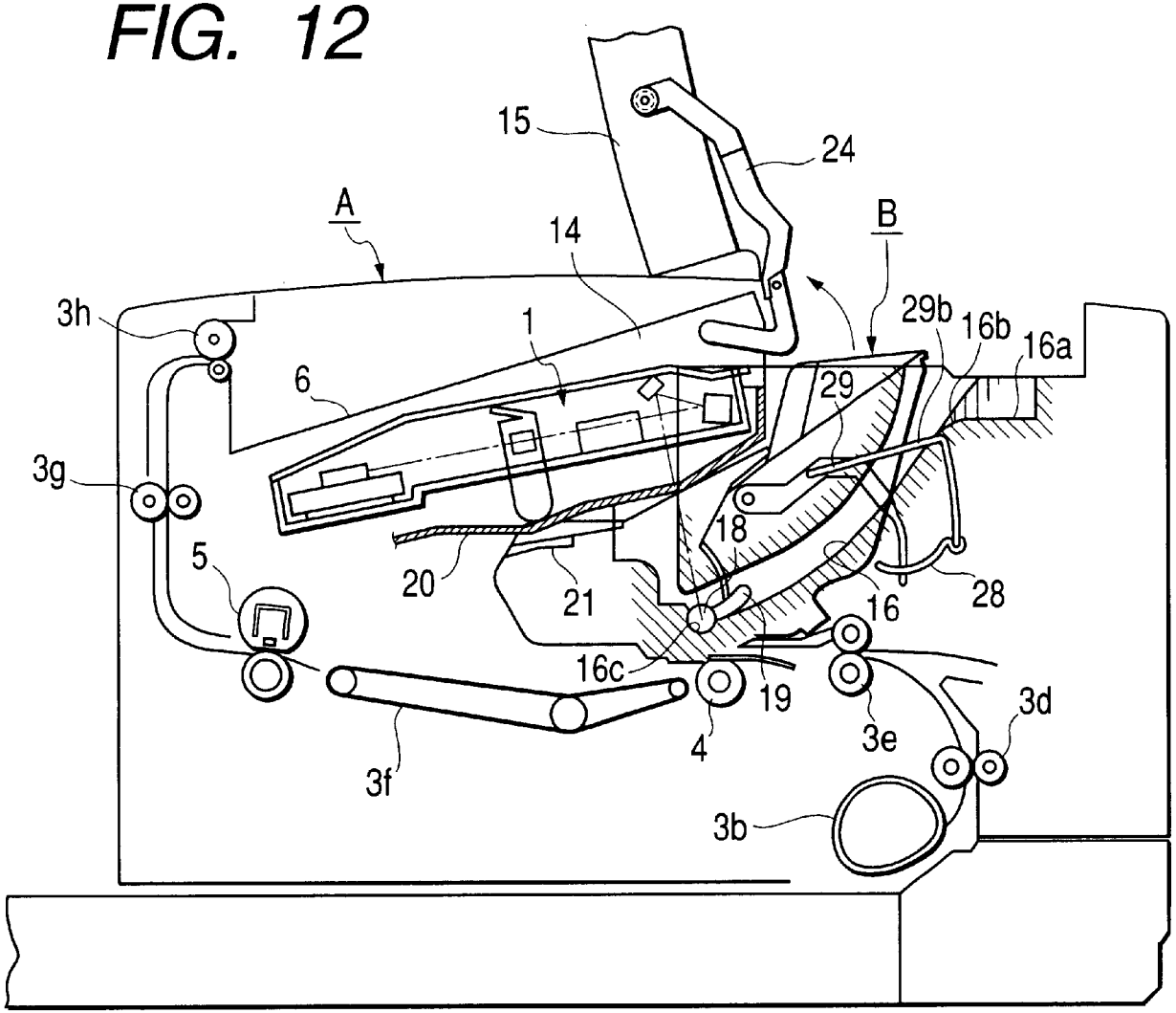
FIG. 12 is an explanatory inside schematic view of the electrophotographic image forming apparatus in a state for the detachment of the process cartridge therefrom.

When the process cartridge B is taken out from the apparatus main body 14, as shown in FIG. 12, the opening and closing member 15 is opened to release the pressurization by the pressure member 24. After the process cartridge B is pulled up so that the bosses 18 of the cartridge B run over the reception concave portions 16*c*, the cartridge B can be taken out in such a manner that the ribs 19 move along the guide rails 16 while the cartridge B is pulled up to turn in a counter-clockwise rotation direction in FIG. 12.

Moreover, an opening portion through which the photosensitive drum 7 touches the recording medium 2 to be transported is formed at the lower part of the cartridge frame described above. A drum shutter member 28 closes the opening portion when the process cartridge B is not used, and thereby the photosensitive drum 7 is protected. As shown in FIG. 6, the drum shutter member 28 is rotatably supported by a shutter arm 27 provided rotatably around a shaft 26 on one side of the outside surfaces in the lengthwise direction of the developing frame body 12 and a link member 29 provided rotatably around the rotation center 29*a* on the outer side surfaces in the lengthwise direction of the cartridge frame body.

Figure 8:
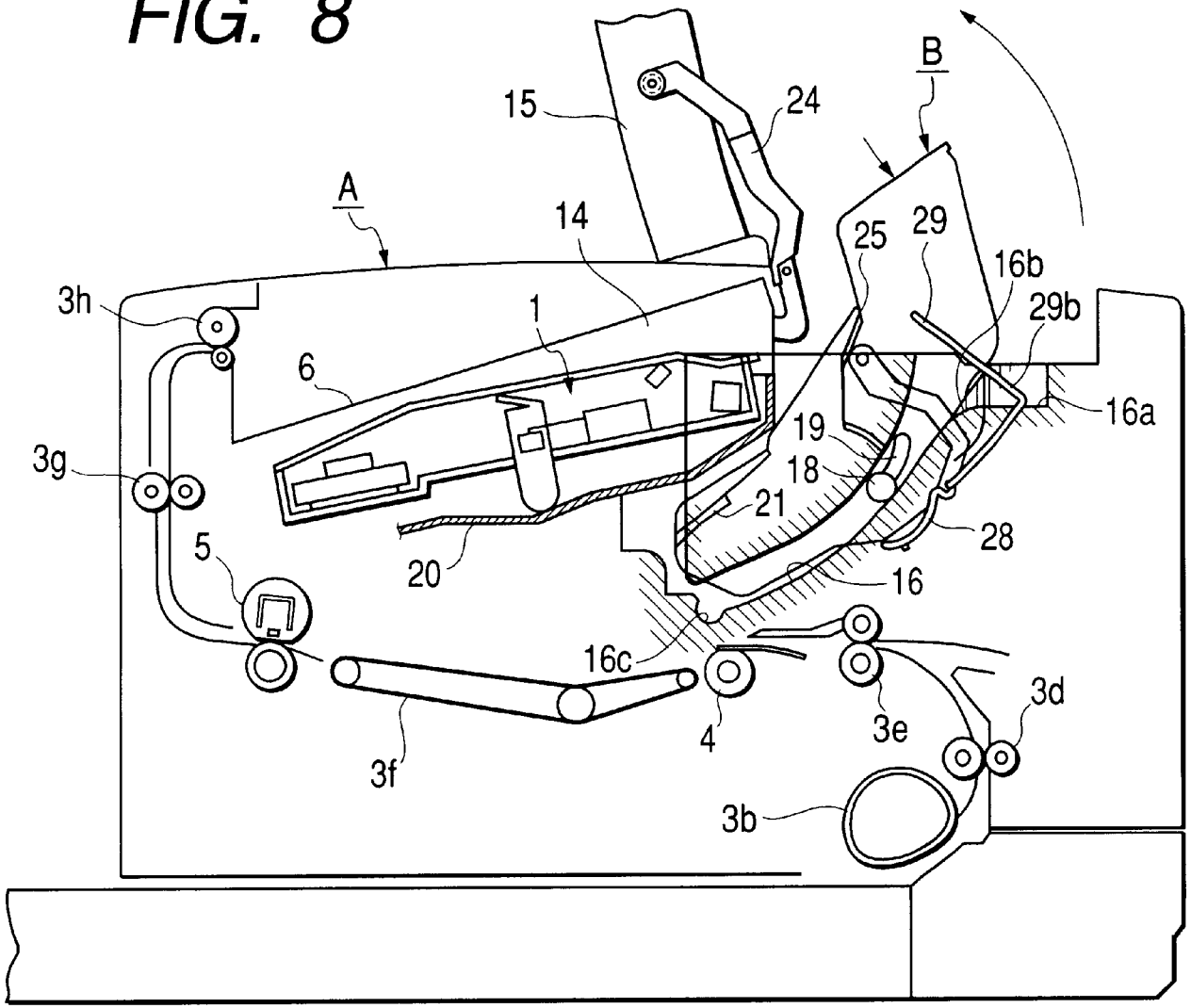
FIG. 8 is an explanatory inside view of the electrophotographic image forming apparatus with the process cartridge being half mounted in the apparatus main body.

Then, as described above, when the process cartridge B is inserted into the apparatus main body 14 along the guide rails 16, a projecting portion 29*b* formed by the bending of the link member 29 touches the first inclining planes 16*a* and the second inclining planes 16*b* of the guide rails 16 so that the shutter member 28 is opened (see FIG. 8 and FIG. 9). Conversely, after the process cartridge B is pulled out from the apparatus main body 14, the shutter member 28 is made to close automatically by being biased by a torsion coil spring 30 (see FIG. 6) attached on the shaft 26.

Incidentally, when a user attaches or detaches the process cartridge B in the apparatus main body 14, as shown in FIG. 7, the user handles the process cartridge B by grasping a grip portion formed on the developing frame body 12. The grip portion is formed with an uneven surface by many ribs 12*c* (see FIG. 6) on an inclining plane formed at the upper part of the cartridge frame body in the lengthwise direction thereof (or the direction orthogonal to the attachment and detachment direction of the process cartridge B into the apparatus main body 14). Moreover, as shown in FIG. 5, a curved portion 12*a* projecting downwards is formed at the lower part of the cartridge frame body. A plurality of ribs 12*a*9 are formed on the curved-portion 12*a* in the same direction as that of the ribs 12*c* to constitute the grip portion. When the user holds the process cartridge B, the user grasps it by the grip portions (or the portions of the ribs 12*c*1 and 12*a*9) and handles process cartridge B such that the bosses 18 and the ribs 19, both being formed on the cleaning frame body 13, move along the guide rails 16. Thus, the user performs the attachment or the detachment of the process cartridge B in the apparatus main body 14.

Next, the charge elimination of the photosensitive drum 7 is described.

The memory element 101 equipped in the process cartridge B stores various kinds of information concerning the process cartridge B. By the connection of the memory element 101 with the connecting portion (not shown), the memory element 101 can exchange signals with the apparatus main body 14 or an external device.

Hereupon, the various kinds of information to be stored in the memory element 101 are individual identification information of the process cartridge B, information indicating the remaining amount of toner, information concerning incorporated parts, settings of process conditions, or the like. In the present embodiment, at least the information concerning the use history of the process cartridge B is stored in the memory element 101. Then, by means of the information, it can be judged whether the process cartridge B is new or not.

As the information concerning the use history of the process cartridge B, the predetermined information indicating that the process cartridge B is new can be stored in the memory element 101 in advance. The information generally is erased when the process cartridge B is initially mounted in the apparatus main body 14. Or, when the process cartridge B is initially mounted in the apparatus main body 14, the predetermined information indicating that the process cartridge is being used may newly be written in the memory element 101.

Figure 3:
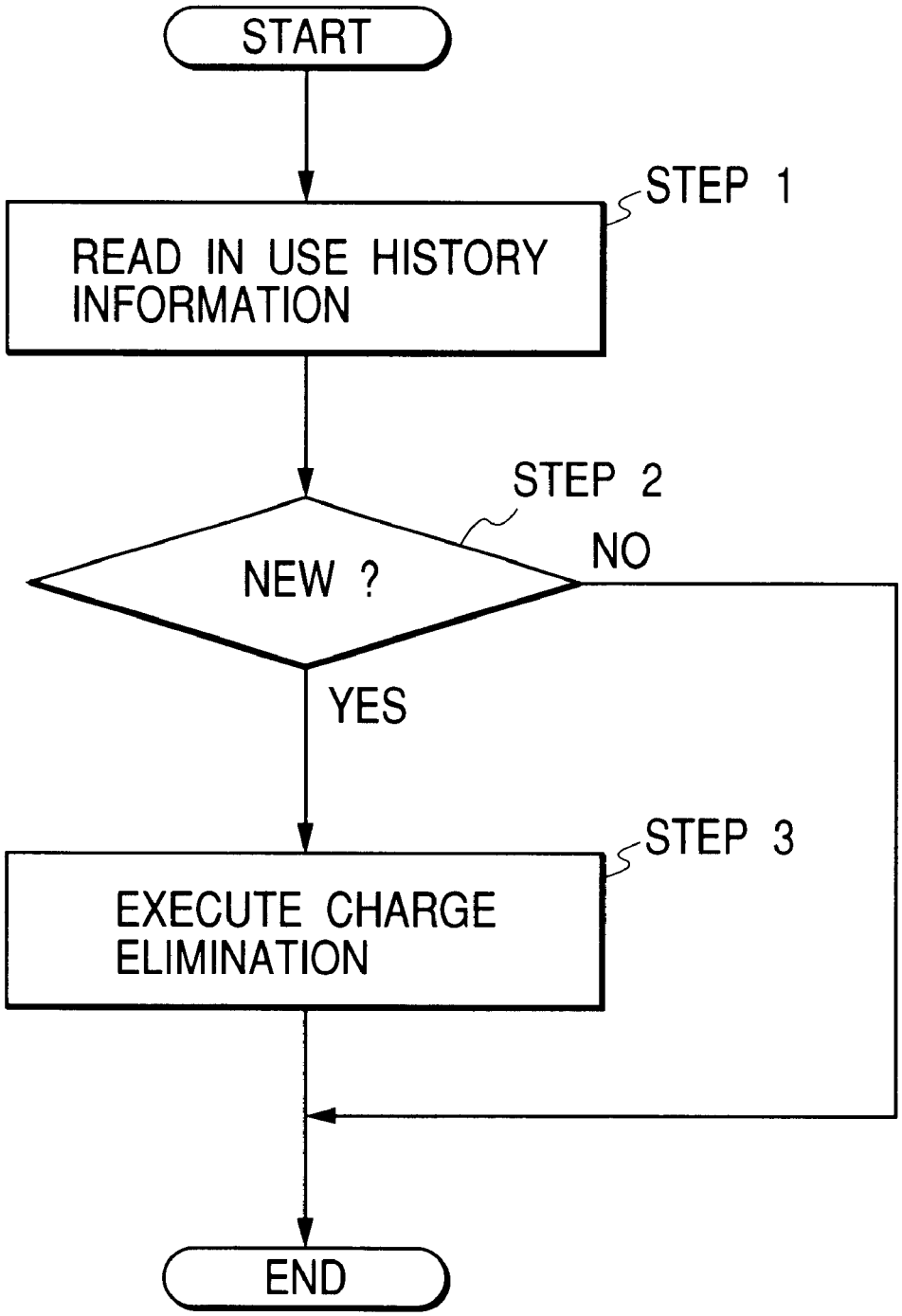
FIG. 3 is a flowchart showing an embodiment of a charge elimination procedure.

FIG. 2 and FIG. 3 are referred to while charge elimination procedures are described.

FIG. 2 is a block diagram of the electrophotographic image forming apparatus A of the present embodiment. FIG. 2 shows the apparatus main body 14 of the apparatus A and the process cartridge B. The controller 102 of the apparatus main body 14 is connected with the memory element 101 of the process cartridge B in the state such that the cartridge B is connected with the apparatus main body 14. Moreover, the power supply supplies electric power to the controller 102. The controller 102 totally controls the operations of each driving system (or driving power source) in the apparatus, a conveying system 3 of the recording medium 2, the fixing means 5, exposure means 1 or optical system, the charging roller 8 as the charging means, the developing means 10 and the like that are integrated into the process cartridge B.

FIG. 3 is a flowchart showing the charge elimination procedures. At the beginning of the procedures of the charge elimination are, first, the information concerning the use history of the process cartridge B is read into the controller 102 provided in the apparatus main body 14 (Step 1). Next, the controller 102 judges whether the process cartridge B is new (non-used) or not by the read information concerning the use history (Step 2). Then, when the process cartridge B is judged to be new at Step 2, the charge elimination operation thereof is executed (Step 3).

For example, if predetermined information has been stored in the memory element 101 in the case where the process cartridge B is new as described above, the electrophotographic image forming apparatus A judges whether the process cartridge B is new or not by confirming the information, and the apparatus A erases the information after the beginning of the use of the cartridge B. Consequently, it can be judged that the process cartridge B is not new at the time of the next detection. Or, the apparatus A may employ a method in which the use history information is not stored in the memory element 101 of a new process cartridge B and the new information is stored in the memory element 101 when the process cartridge B is begun to be used. In this case, if the apparatus A is configured to store the detection information concerning a detection result of the remaining amount of developer, the number of rotations of various rotation bodies such as the photosensitive drum 7, the charging roller 8, the developing means 10, the toner feeding members 10*b*1, 10*b*2 and the like, and other information besides the information indicating the beginning of the usage into the memory element 101, the apparatus A can judge whether the process cartridge B is new or not by confirming whether any of the aforesaid information is written in the memory element 101 or not.

On the other hand, when the process cartridge B is judged not to be new at Step 2, the electrophotographic image forming apparatus A does not execute the charge elimination operation at Step 3, and executes the initial operation that is usually performed when the power supply of the apparatus A is turned on.

In the charge elimination operation at Step 3, the image forming apparatus A first rotates the photosensitive drum 7 to expose the whole peripheral surface of the photosensitive drum 7 by light from the optical system 1. Next, only the AC voltage component Vac is applied to the photosensitive drum 7 from the charging roller 8. Then, after the photosensitive drum 7 has rotated by one turn, the electrophotographic image forming apparatus A stops the rotation of the photosensitive drum 7. After that, the apparatus A gradually reduces the AC voltage component Vac to converge to a zero volt. Because the DC component Vdc is not superposed on the AC voltage component Vac in this procedure, the surface potential of the photosensitive drum 7 converges to zero volts. Moreover, because the AC voltage component Vac is turned off after being reduced, no spike waveform is generated.

As described above, in some cases, the photosensitive drum 7 is charged by the application of stresses such as a frictional force and the like caused by, for example, vibrations, impact and the like during the transportation thereof in a packed state to the portion where the photosensitive drum 7 abuts against the charging roller 8 or the portion where the drum 7 abuts against the cleaning blade 11*a*. However, as described above, the present embodiment is configured such that the memory element 101 to store the use history of the process cartridge B is mounted in the cartridge B to perform the charge elimination operation in addition to a usual initial operation if a not used process cartridge B is mounted into the apparatus main body 14. Thereby, the charge of the photosensitive drum 7 can be eliminated before the image formation thereon and the so-called drum memory can be removed. Consequently, the occurrence of a black streak or a white streak on an image owing to the drum memory in the initial state of the process cartridge B can be prevented.

Incidentally, although the process cartridge B forms monochromatic images in the embodiment described above, the present invention can suitably be applied to a cartridge provided with a plurality of developing means to form an image of a plurality of colors (e.g. an image of two colors, an image of three colors, an image of full colors, and the like) as well as the process cartridge B forming the monochromatic images.

Moreover, as for the developing method, it is possible to use various known developing methods such as the two-component magnetic brush developing method, the cascade developing method, the touchdown developing method, the cloud developing method and the like. Moreover, the electrophotographic photosensitive body thereof is not limited to the aforesaid photosensitive drum 7, but, for example, the following electrophotographic photosensitive bodies can be applied. At first, a photoconductor can be used as a photosensitive body, and, for example, amorphous silicon, amorphous selenium, zinc oxide, titanium oxide, an organic photoconductor (OPC), and the like can be used as the photoconductor. The shape of the photosensitive body may be, for example, a rotation body such as a drum, a belt and the like, a sheet, and the like. Generally, the drum photosensitive body or the belt photosensitive body is used. For example, the drum photosensitive body is made by the evaporation or the coating of a photoconductor on a cylinder made of an aluminum alloy.

Moreover, a contact charging member being the charging means may be a blade type (or a charging blade) besides the aforesaid roller type.

In the present invention, the process cartridge is equipped with an electrophotographic photosensitive body and at least either of charging means or cleaning means. Accordingly, a typical embodiment of the process cartridge includes the electrophotographic photosensitive body, either of the charging means or the cleaning means, and developing means, all being integrated to be a cartridge mountable to the apparatus main body detachably. The process cartridge may include the electrophotographic photosensitive body, the charging means, the cleaning means and the developing means, all being integrated to be a cartridge mountable in the apparatus main body detachably. The process cartridge may include the electrophotographic photosensitive body and either of the charging means or the cleaning means, all being made to be a cartridge mountable in the apparatus main body detachably.

Moreover, although the laser beam printer is exemplified as the image forming apparatus in the aforesaid embodiment, the present invention can be used in other image forming apparatus such as an electrophotographic copying machine, a facsimile apparatus, a word processor and the like.

What is claimed is:

1. An electrophotographic image forming apparatus for forming an image on a recording medium, said electrophotographic image forming apparatus being capable of detachably mounting a process cartridge, said electrophotographic image forming apparatus comprising:

(a) mounting means for detachably mounting the process cartridge, the process cartridge including an electrophotographic photosensitive body, process means for performing a process on the electrophotographic photosensitive body and having at least one of charging means for charging the electrophotographic photosensitive body and cleaning means for cleaning the electrophotographic photosensitive body, and storing means for storing information;

(b) conveying means for conveying the recording medium;

(c) controlling means for controlling an operation of said electrophotographic image forming apparatus to execute reading and/or writing of the information to the storing means; and (d) exposing means for exposing the electrophotographic photosensitive body to light, wherein said controlling means controls a charge elimination operation of the electrophotographic photosensitive body on a basis of the information in the storing means.

2. An electrophotographic image forming apparatus according to claim 1, wherein said controlling means determines whether the process cartridge is in a non-used state on a basis of the information in the storing means, and executes the charge elimination operation of the electrophotographic photosensitive body if the process cartridge is determined to be in the non-used state.

3. An electrophotographic image forming apparatus according to claim 1, wherein said controlling means determines whether the process cartridge is in a non-used state on a basis of the information in the storing means, and does not execute the charge elimination operation of the electrophotographic photosensitive body if the process cartridge is not determined to be in the non-used state.

4. An electrophotographic image forming apparatus according to claim 1, wherein the information in the storing means is a piece of information indicating whether the process cartridge is in a non-used state.

5. An electrophotographic image forming apparatus according to claim 1, wherein said controlling means erases the information in the storing means or writes a piece of predetermined information in the storing means if the process cartridge is determined to be in a non-used state on a basis of the information in the storing means.

6. An electrophotographic image forming apparatus according to claim 5, wherein the predetermined information is a piece of information indicating that the process cartridge is in a used state.

7. A process cartridge mountable in a main body of an electrophotographic image forming apparatus detachably, said cartridge comprising:

an electrophotographic photosensitive body;

charging means for charging a surface of said electrophotographic photosensitive body;

cleaning means for cleaning said electrophotographic photosensitive body; and storing means for storing information, wherein said storing means stores information for controlling a charge elimination operation of said electrophotographic photosensitive body when said process cartridge is mounted in the main body of the electrophotographic image forming apparatus.

8. A process cartridge according to claim 7, wherein the information for controlling the charge elimination operation of said electrophotographic photosensitive body is a piece of information indicating whether said process cartridge is in a non-used state.

9. A process cartridge according to claim 7, wherein, in a case where information indicating that said process cartridge is in a non-used state is stored when said process cartridge is mounted in the main body of the electrophotographic image forming apparatus, the information indicating that said process cartridge is in a non-used state is erased or a piece of predetermined information is written in said storing means.

10. A process cartridge according to claim 9, wherein the predetermined information is a piece of information indicating that said process cartridge is in a used state.

11. A process cartridge according to claim 7, wherein said process cartridge is a cartridge composed of said electrophotographic photosensitive body, said charging means, said cleaning means, and developing means for feeding a developer to said electrophotographic photosensitive body, all being integrated to be one body, and said process cartridge is detachably mountable in the main body of the electrophotographic image forming apparatus.

* * * * *

UNITED STATES PATENT AND TRADEMARK OFFICE

CERTIFICATE OF CORRECTION

PATENT NO. : 6,704,522 B2
DATED : May 9, 2004
INVENTOR(S) : Yoshikazu Sasago et al.

It is certified that error appears in the above-identified patent and that said Letters Patent is hereby corrected as shown below:

Column 2,
Line 22, “abuts” should read -- abut --.

Column 5,
Line 30, “triboelectification” should read -- triboelectrification --.

Column 6,
Line 19, “come” should read -- comes --; and “swell” should read -- swells --.

Column 7,
Line 59, “ribs 12c” should read -- ribs 12c1 --.

Column 8,
Line 1, “ribs 12c” should read -- ribs 12c1 --.

Signed and Sealed this

Thirteenth Day of July, 2004

JON W. DUDAS
*Acting Director of the United States Patent and Trademark Office*